United States Patent [19]

McCarthy

[11] 4,074,832

[45] Feb. 21, 1978

[54] FOOD DISPENSER HAVING DOOR ACTUATED AGITATORS

[76] Inventor: John J. McCarthy, 10540 Dolecetto Drive, Rancho Cordova, Calif. 95670

[21] Appl. No.: 723,177

[22] Filed: Sept. 14, 1976

[51] Int. Cl.[2] ..... B67D 3/00; G01F 13/00

[52] U.S. Cl. ..... 222/245; 222/517

[58] Field of Search ..... 221/200, 202, 203; 222/226, 232, 233, 234, 228, 245, 517, 558, 363

[56] References Cited

U.S. PATENT DOCUMENTS

| | | | |
|---|---|---|---|
| 322,952 | 7/1885 | Miller | 222/234 X |
| 966,833 | 8/1910 | Heyser | 222/226 |
| 1,929,324 | 10/1933 | Martin | 222/234 |
| 2,157,282 | 5/1939 | DeJavannes | 222/363 X |

FOREIGN PATENT DOCUMENTS

| | | | |
|---|---|---|---|
| 697,807 | 11/1965 | Italy | 222/226 |

*Primary Examiner*—Robert B. Reeves
*Assistant Examiner*—David A. Scherbel
*Attorney, Agent, or Firm*—Blair & Brown

[57] ABSTRACT

A food dispenser including a relatively large hopper for holding a supply of dry or granular type food, and a downwardly tapering section leading to a manually movable control door which dispenses a predetermined quantity of the food. Attached to the control door, and actuated thereby, are a plurality of intermeshing pegs, movable in the tapering section, to break up dry products which have a tendency to stick or pack together, thereby always assuring that the control door will dispense an accurate amount.

7 Claims, 9 Drawing Figures

FIG. 3.
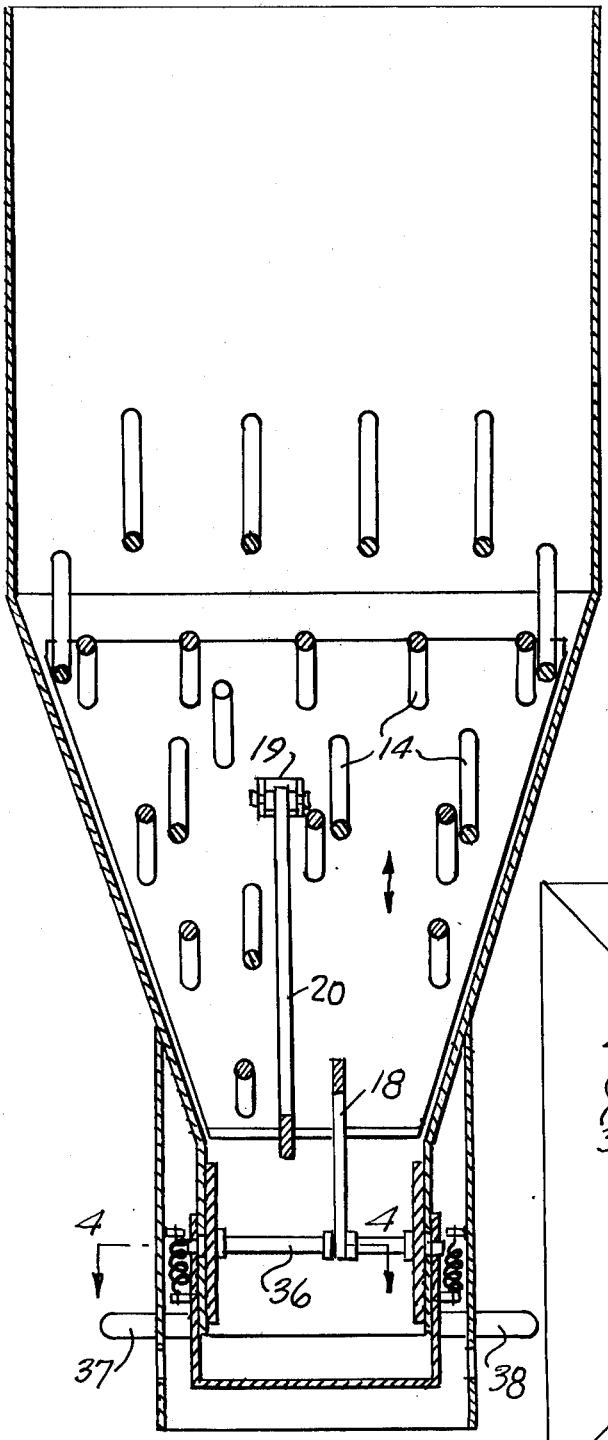
FIG. 4.
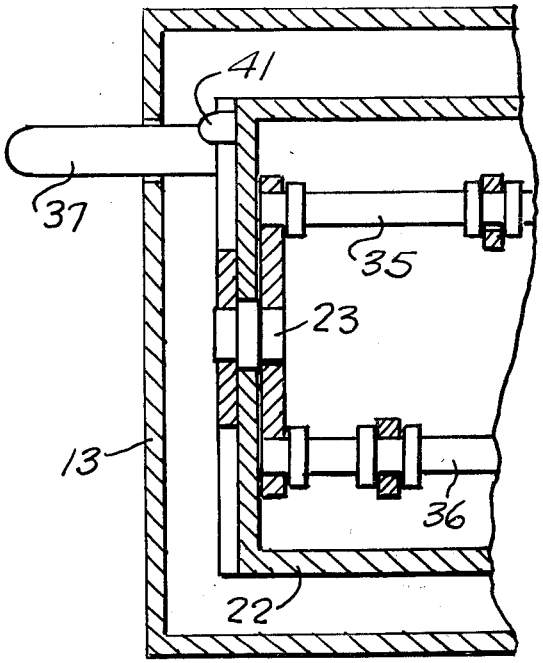
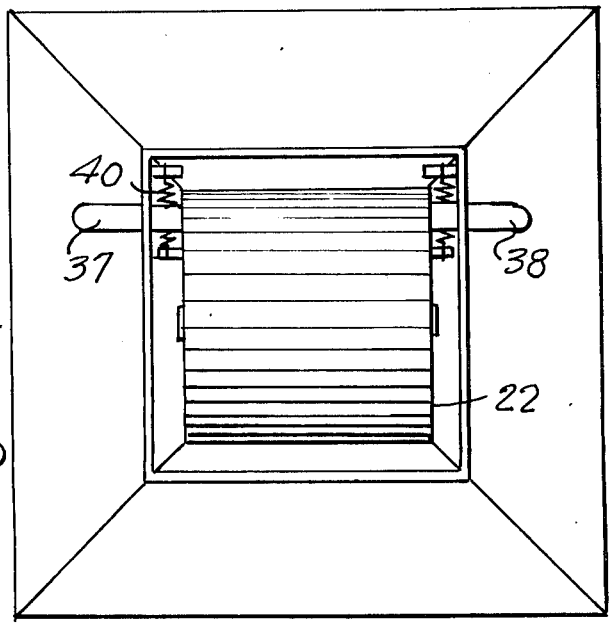
FIG. 5.

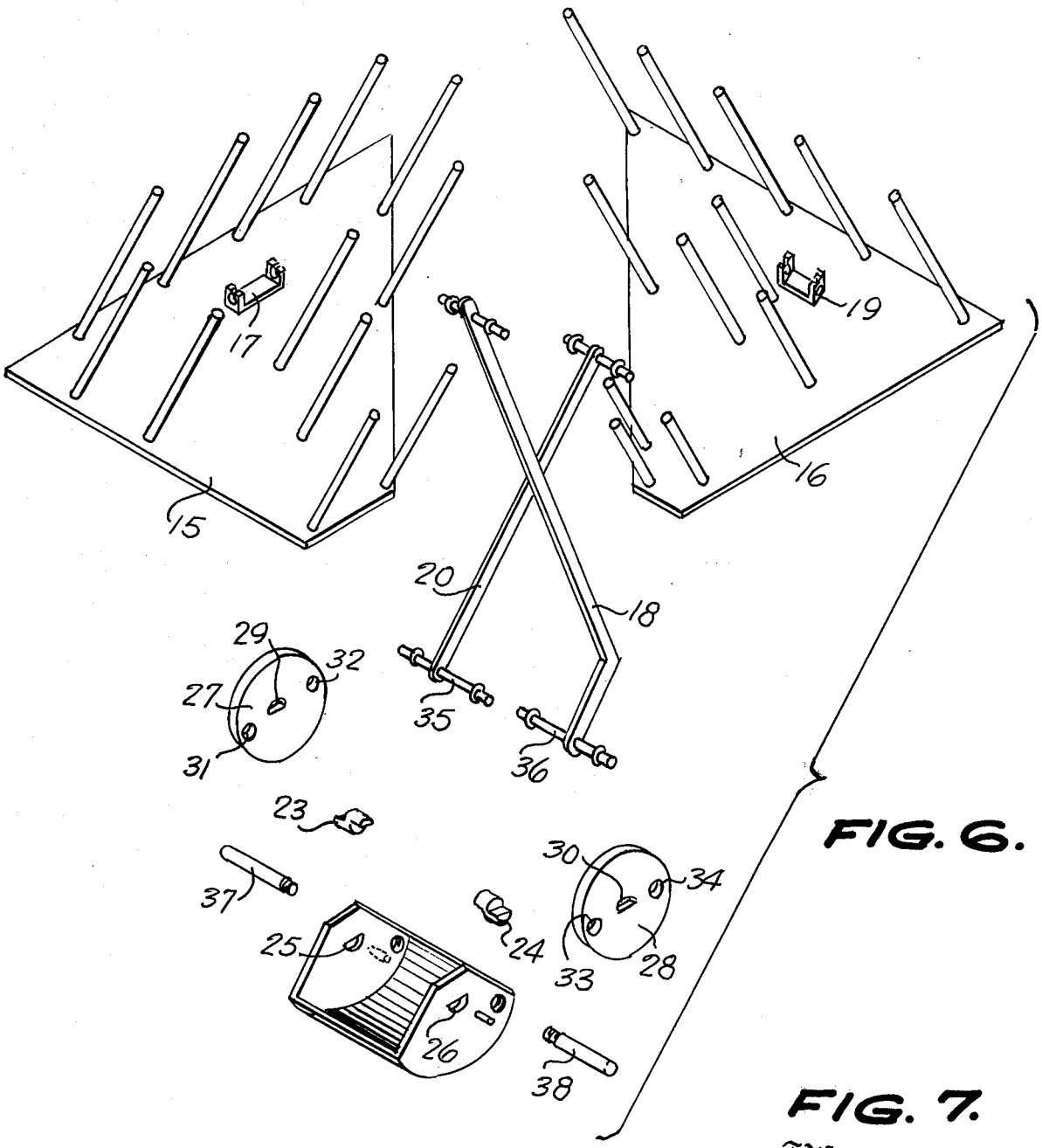
FIG. 6.
FIG. 7.
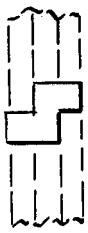

FOOD DISPENSER HAVING DOOR ACTUATED AGITATORS

BACKGROUND OF THE INVENTION

Field of the Invention

The present invention relates to a dry food dispenser which accurately presents a fixed amount of food, each time of operation.

Dispensers for always accurately measuring out and presenting an amount of dry food material having uniform consistancy are most desirable devices. Many such machines in the past have been faulty because the food would often pack together, or cake up, and thus not freely feed down from a hopper into the real dispensing cup.

SUMMARY OF THE INVENTION

The present invention of a dry food dispenser includes a relatively large hopper for holding a large reservoir of dry food, a downwardly tapering section from the hopper, feeding a manually operable control door which dispenses a predetermined quantity of the food. Working with the control door, and attached to it so that they work together, there are a plurality of intermeshing pegs, which oscillate back and forth in the tapering section, to break up dry products which have a tendency to clot or stick together. This arrangement assures that the control door will dispense an accurate amount of food each time the machine is operated.

The primary object of the invention is to provide a dispenser for dry food products that will deliver an accurate quantity each time by making the product maintain a uniform consistancy.

Other objects and advantages will become apparent in the following specification when considered in light of the attached drawings.

BRIEF DESCRIPTION OF THE DRAWINGS

FIG. 3 is a sectional view taken along the line 3—3 of FIG. 2, looking in the direction of the arrows;

FIG. 4 is a sectional view taken along the line 4—4 of FIG. 3, looking in the direction of the arrows;

FIG. 5 is a bottom view of the control door;

FIG. 6 is an exploded view of the control door, its mounting, and the intermeshing pegs;

FIG. 7 is a view of the control door axles;

DESCRIPTION OF THE PREFERRED EMBODIMENT

Figure 1:
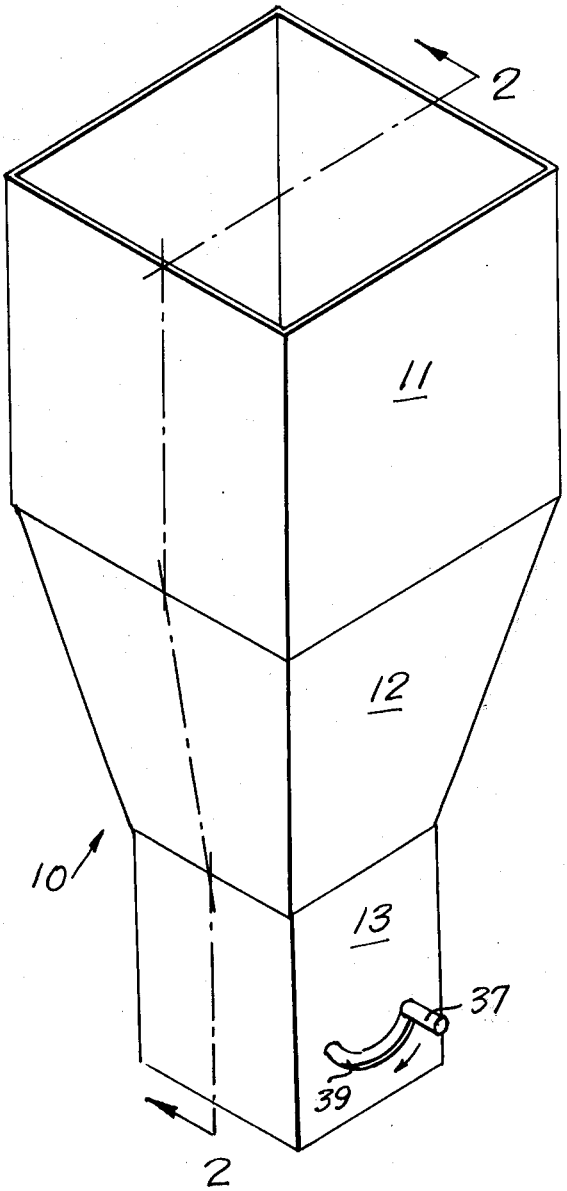
FIG. 1 is a perspective view of the overall invention.

Referring now to the drawings in detail, wherein like reference characters indicate like parts throughout the several figures, the reference numeral 10 indicates generally the entire dry food dispensing system of the invention and incorporating a rather large storage hopper 11 on top, a generally downward tapering mixer section 12 below the hopper, and finally a splash guard 13 at the bottom.

Dispenser size can be varied to meet the need, and use, and the dispensers can be made from such materials as wood, plastic, or metal, and can be molded, injected or fabricated, and can be used in any situation where dry products need dispensing or storing. Also the dispensers may be mounted on walls, under shelves, or cabinets, or with a through-shelf mounting.

Within the tapering mixer section 12 there are a plurality of intermeshing pegs 14 which move up and down. Sliding along the inside walls of section 12, and on opposite walls from each other, there is a mixer peg holder 15 and 16, holders 15 and 16 each having a plurality of pegs 14 attached to it, with the pegs extending outward from the holder itself and reaching almost across mixing area 12.

Figure 2:
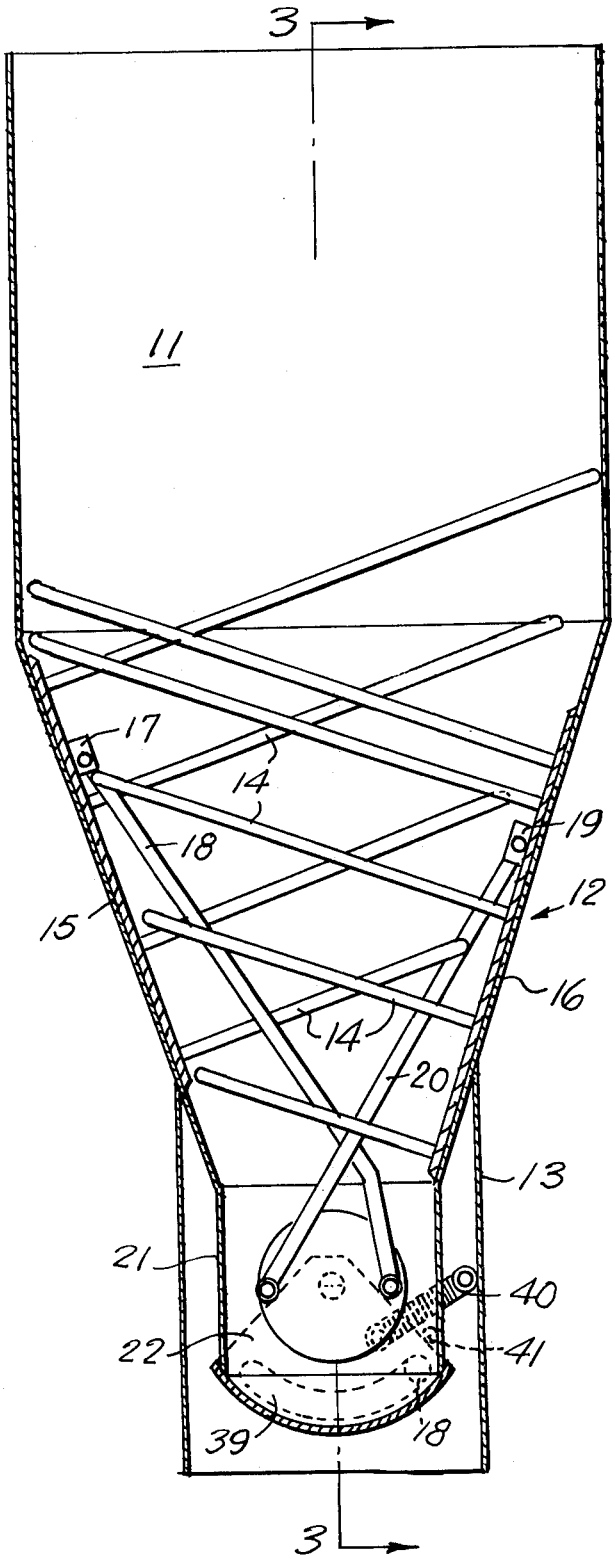
FIG. 2 is a sectional view taken along the line 2—2 of FIG. 1, looking in the direction of the arrows.
Figure 8:
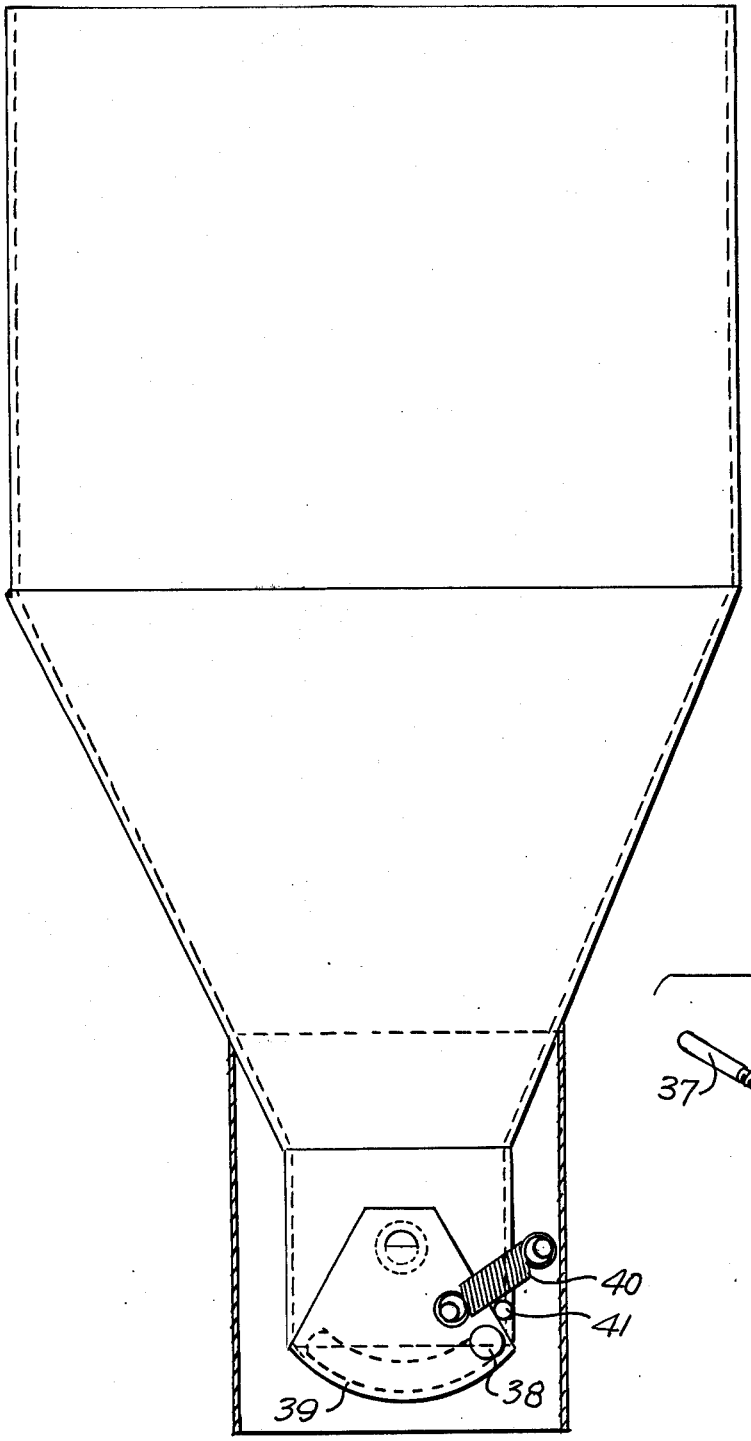
FIG. 8 is an elevation, side view of the entire invention, showing the control door, its return spring, and its limit stop.
Figure 9:
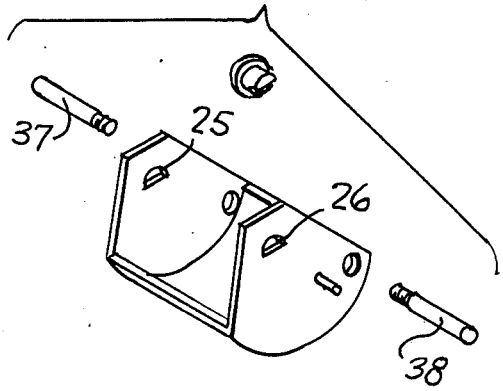
FIG. 9 is a perspective view of the control door.

Near the top of holder 15, and nestled among pegs 14, there is a U-shaped bracket 17 which serves as a terminal mounting for a torque arm 18. On the opposite side, and onto holder 16, there is a comparable bracket 19, attached to the end of torque arm 20. From the views of FIGS. 2, 3, and 6 it should be noted that pegs 14 are mounted on holders 15 and 16 in such a spaced relation to each other that there will be no abutment or striking of the pegs on the holders as they move up and down.

Below tapering, mixing area 12 is a splash guard 13 which serves as a cover and protection for a discharge chamber 21, discharge chamber 21 being in fact the heart of the dispenser 10 because it includes an arcuate, swingable control door 22 which dispenses the food.

The control door 22 is approximately a third of a circle and extends beyond the edge of discharge chamber 21, far enough to provide a none-leak movement of the product. Control door 22 also touches the front and rear edge of discharge chamber 21 to provide a near air-tight and leak proof movement.

At each end of control door 22 there is a mounting pivot, or axle 23 and 24, that is somewhat S-shaped and has half of the diameter cut away to form a flat side on each end of the axle (see FIGS. 6 and 7). The center, or round part of pivots 23 and 24 extend through a hole in discharge chamber 21 while one flat end protrudes through a semi-circular hole 25 and 26 in each end of the control door 22.

Circular disks 27 and 28 are placed just inside the control door 22, and flat against the narrow ends of the door, with the remaining flat ends of pivots 23 and 24 threaded through semi-circular holes 29 and 30 in the disks. From this construction it should be clear that when control door 22 is moved, the semi-circular holes 25 and 26 cause pivots 23 and 24 to also rotate, these in turn causing semi-circular holes 29 and 30 to move and disks 27 and 28 to rotate. The disks and the control door are effectively locked together.

Each circular disk 27 and 28 has two holes 31 and 32 and 33 and 34 cut through it to receive the ends of shafts 35 and 36. FIG. 6 illustrates these disks and shafts and shows that the shafts are mounted across the ends of torque rods 18 and 20.

So as to operate control door 22, and dispense the food, there is a lever 37 and 38, attached to the door, and extending through a curved slot 39 cut in the side of splash guard 13.

A spring 40 is used to return control door 22 back to its closed position, and a stop-peg 41 prevents the door from moving too far.

In the use and operation of the invention a quantity of dry food is placed in hopper 11 until it basically fills mixer section 12 and a portion of the hopper. When it is necessary to dispense an amount of the food one of the levers 37 or 38 is pushed along curved slot 39 to thereby rotate the control door and dump the food which has collected in the curved door. As control door 22 turns, then cam-pivots 23 and 24 function to likewise turn disks 27 and 28, which likewise move torque rods 18 and 20. Since the rods are attached on opposite sides of the disk centers, when the disks revolve, one rod moves upward as the other moves downward.

Peg holders 15 and 16 slide along the sides of mixer section 12 and the pegs 14 work to break-up any packed or hardened areas of food in the mixer section. This action thereby assures that a sufficient quantity of food always flows down through the mixer section to fill the curved control door.

After the food is dumped from the control door return spring 40 pulls the door shut again until the door hits stop 41. The system is then ready to dispense again.

Having thus described the preferred embodiment of the invention it should be understood that numerous structural modifications and adaptations may be resorted to without departing from the spirit of the invention.

What is claimed is:

1. A dry food dispenser which assures that the food has a substantially uniform consistancy comprising, a storage hopper, a mixer section connected to said storage hopper, and a discharge chamber remote from said storage hopper but connected to said mixer section, said discharge chamber including a swingable door remote from said mixing section which allows the food to be dispensed when opened, said swingable door being pivotally mounted on said discharge chamber through axles, said axles being further connected to a pair of discs disposed within said discharge chamber so that when said swingable door is rotated, said discs also rotate, a pair of shafts interconnecting said discs disposed diametrically opposite to each other so that when said discs rotate said shafts translate in an opposite vertical sence, and means disposed on said shafts to agitate the dry food within said mixer section to assure that the dry food will have a uniform consistancy and is not clotted.

2. The dispenser of claim 1 in which said means to agitate the dry food includes a pair of torque arms each connected to one of said shafts so that each shaft has a torque arm, each of said torgue arms being pivotally connected to peg holders disposed in said mixing section, said peg holders having pegs disposed thereon so that the pegs of one peg holder are intermeshed with the pegs of the other peg holder and said pegs therefore provide a reciprocating action which will work on the dry food and render it of uniform consistancy when said swingable door is moved.

3. The device of claim 2 in which said swingable door is provided with a lever type handle to open and close it.

4. The device of claim 3 in which said lever rides in a trackway.

5. The device of claim 4 in which said swingable door is normally biased in the closed position.

6. The device of claim 5 in which said biasing has a stop means to prevent the door from moving too far.

7. The device of claim 2 in which said discharge chamber is surrounded by a splash guard to assure that the dispensed food is not dispensed over a wide area.

* * * * *